US008340328B2

(12) United States Patent
Wang et al.

(10) Patent No.: US 8,340,328 B2
(45) Date of Patent: Dec. 25, 2012

(54) ACOUSTICS TRANSDUCER

(75) Inventors: Di-Bao Wang, Taipei County (TW); Chin-Fu Kuo, Tainan County (TW); Chia-Yu Wu, Kaohsiung (TW); Jien-Ming Chen, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 365 days.

(21) Appl. No.: 12/767,658

(22) Filed: Apr. 26, 2010

(65) Prior Publication Data

US 2011/0123053 A1 May 26, 2011

(30) Foreign Application Priority Data

Nov. 25, 2009 (TW) ..... 98140072 A

(51) Int. Cl.
*H04R 25/00* (2006.01)

(52) U.S. Cl. ..... 381/175

(58) Field of Classification Search ..... 381/175
See application file for complete search history.

(56) References Cited

U.S. PATENT DOCUMENTS 4,533,795 A * 8/1985 Baumhauer et al. ..... 381/174
6,794,737 B2 9/2004 Romano et al.
6,973,722 B2 12/2005 Hantschel et al.
7,172,707 B2 2/2007 Fork et al.
2006/0256984 A1 * 11/2006 Song et al. ..... 381/174
2007/0058825 A1 3/2007 Suzuki et al.
2007/0121972 A1 5/2007 Suzuki et al.
2007/0201710 A1 8/2007 Suzuki et al.
2008/0019543 A1 1/2008 Suzuki et al.
2008/0212409 A1 9/2008 Lutz
2009/0074222 A1 3/2009 Song

* cited by examiner

*Primary Examiner* — Jianchun Qin

(57) ABSTRACT

According to an embodiment of the disclosure, an acoustics transducer is provided, which includes a support substrate having an upper surface and a lower surface, the upper surface including a first portion and a second portion surrounding the first portion, a recess extending from the upper surface towards the lower surface, the recess is between the first portion and the second portion of the upper surface, a vibratable membrane disposed directly on the recess, the vibratable membrane including a fixed portion fixed on the support substrate and a suspended portion, and a back plate disposed on the support substrate and opposite to the vibratable membrane. The suspended portion has an edge extending substantially along with an edge of an opening of the recess. The suspended portion is separated from the first portion and the second portion of the upper surface by an inner interval and an outer interval, respectively.

21 Claims, 11 Drawing Sheets

ACOUSTICS TRANSDUCER

CROSS REFERENCE

This application claims the benefit of T.W. Patent Application No. 098140072, filed on Nov. 25, 2009, the entirety of which is incorporated by reference herein.

BACKGROUND OF THE DISCLOSURE

1. Field of the Disclosure

The present disclosure relates to an acoustics transducer, and in particular relates to a condenser type acoustics transducer.

2. Description of the Related Art

An acoustic transducer can transform a detected sound wave signal into an electronic signal, which is capable of being used in a variety of applications. Acoustic transducers have been widely used in electronic products, such as mobile phones, notebook computers, digital video cameras, microphones, and digital voice recorders. An acoustic transducer typically includes a back plate and a membrane structure, which are disposed opposite to each other. When a sound wave propagates to the membrane structure, the distance between the membrane structure and the back plate is changed due to a pressure change caused by the sound wave. The change of the distance between the membrane structure and the back plate leads to a change of capacitance therebetween. Thus, by detecting the capacitance difference, the detected sound wave signal is transformed into an electronic signal.

However, the effects of residual stress such as compressive stress, tensile stress or gradient stress may be easily existing in the membrane structure. These residual stresses may cause the membrane structure to buckle, tighten or bend. Thus, the acoustic sensitivity of the membrane structure may be reduced, and the membrane structure may be damaged easily. Specifically, the gradient stress may cause a failure of the membrane structure.

Therefore, an acoustics transducer having both a good acoustic sensitivity and a structural reliability is desired.

BRIEF SUMMARY OF THE DISCLOSURE

According to an illustrative embodiment, an acoustics transducer is provided. The acoustics transducer includes a support substrate having an upper surface and a lower surface, the upper surface including a first portion and a second portion surrounding the first portion, a recess extending from the upper surface towards the lower surface, wherein the recess is between the first portion and the second portion, a vibratable membrane disposed directly on the recess, the vibratable membrane including a fixed portion and a suspended portion, wherein the fixed portion is fixed on the support substrate, an edge of the suspended portion extends substantially along with an edge of an opening of the recess, an inner gap is between the suspended portion and the first portion of the upper surface, and an outer gap is between the suspended portion and the second portion of the upper surface, and a back plate disposed overlying the support substrate and opposite to the vibratable membrane.

A detailed description is given in the following embodiments with reference to the accompanying drawings.

BRIEF DESCRIPTION OF THE DRAWINGS

The present disclosure can be more fully understood by reading the subsequent detailed description and examples with references made to the accompanying drawings, wherein.

DETAILED DESCRIPTION OF THE DISCLOSURE

The following description is of the best-contemplated mode of carrying out the disclosure. This description is made for the purpose of illustrating the general principles of the disclosure and should not be taken in a limiting sense. The scope of the disclosure is best determined by reference to the appended claims.

It is understood, that the following disclosure provides many different embodiments, or examples, for implementing different features of the disclosure. Specific examples of components and arrangements are described below to simplify the present disclosure. These are, of course, merely examples and are not intended to be limiting. In addition, the present disclosure may repeat reference numbers and/or letters in the various examples. This repetition is for the purpose of simplicity and clarity and does not in itself dictate a relationship between the various embodiments and/or configurations discussed. Furthermore, descriptions of a first layer "on," "overlying," (and like descriptions) a second layer include embodiments where the first and second layers are in direct contact and those where one or more layers are interposing the first and second layers.

According to an embodiment of the disclosure, an inner gap and an outer gap are formed between a vibratable membrane and a support substrate of an acoustics transducer to form "free boundaries" at an inner side and an outer side of the vibratable membrane, which may release residual stress, including a compressive stress and/or a tensile stress, residing in the membrane significantly. Wherein, the "free boundaries" are the formed inner gap and the formed outer gap. The "free boundaries" are located at a position where the membrane and the support substrate are not connected with each other.

Figure 1:
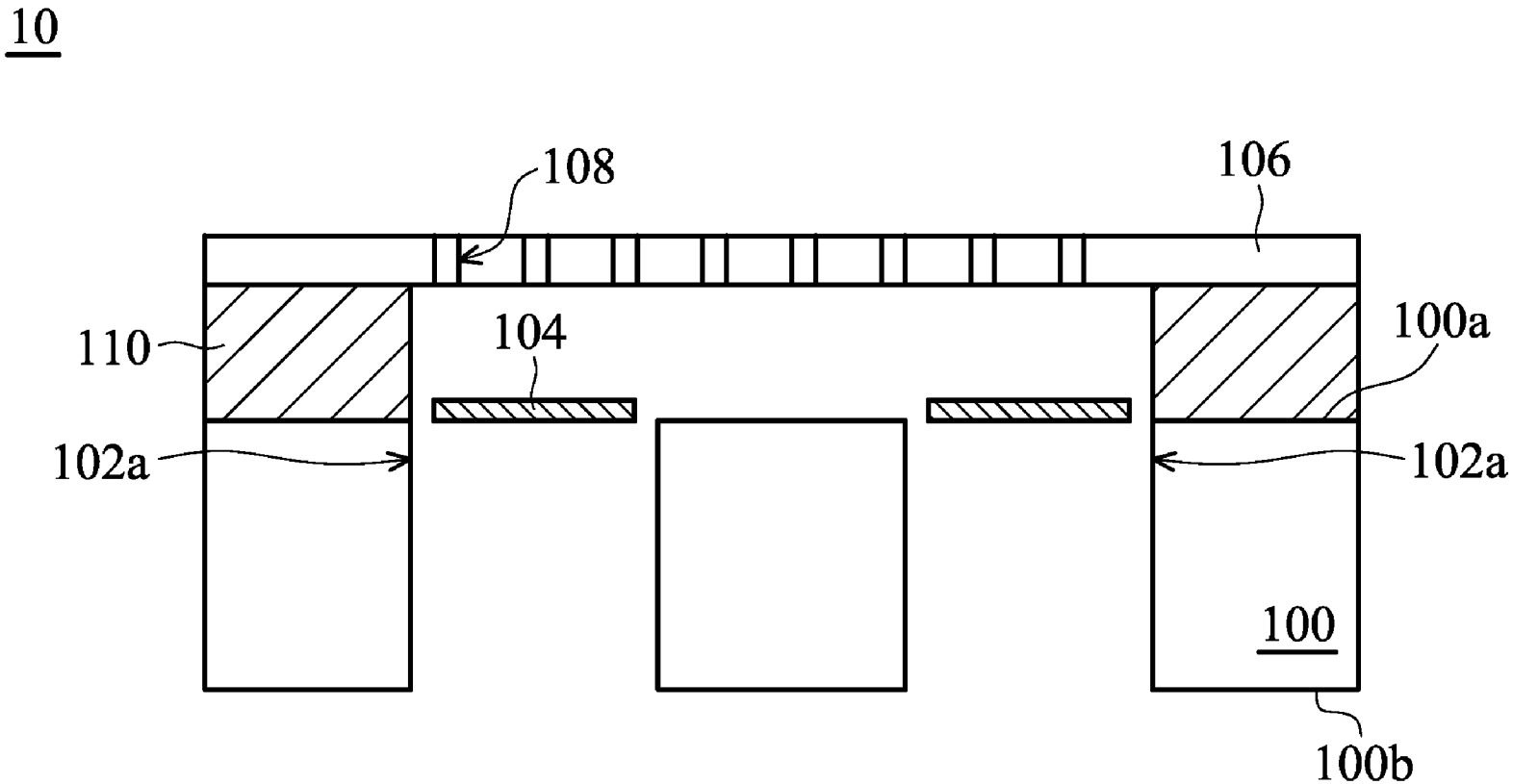
FIG. 1 is a cross-sectional view showing an acoustics transducer according to an embodiment of the present disclosure.

FIG. 1 is a cross-sectional view showing an acoustics transducer 10 according to an embodiment of the present disclosure. In this embodiment, the acoustics transducer 10 includes a support substrate 100 having an upper surface 100*a* and a lower surface 100*b*. The support substrate 100 has a recess 102*a* extending from the upper surface 100*a* towards the lower surface 100*b*. A vibratable membrane 104 and a back plate 106 are disposed overlying the support substrate 100. The vibratable membrane 104 and the back plate 106 are disposed opposite to each other by a distance. For example, in this embodiment, an insulating spacer 110 is disposed between the vibratable membrane 104 and the back plate 106. The vibratable membrane 104 and the back plate 106 are separated from each other by a predetermined distance. At least a hole 108 penetrating through the back plate 106 may be formed in the back plate 106. For example, in the embodiment shown in FIG. 1, a plurality of holes 108 may be formed in the back plate 106 such that air may travel between the back plate 106 and the vibratable membrane 104. When a sound wave propagates to the position between the vibratable membrane 104 and the back plate 106 through the holes 108, pressure difference above and below the vibratable membrane 104 may cause the vibratable membrane 104 to move or deform such that the distance between the vibratable membrane 104 and the back plate 106 is changed. The change of the distance leads to a change of capacitance between the vibratable membrane 104 and the back plate 106. Thus, a sound wave signal is transformed into an electronic signal. In one embodiment, the back plate 106 may include, for example, a metal, semiconductor, or other similar materials.

Thereafter, the manufacturing process of the acoustics transducer 10 according to an embodiment of the disclosure is illustrated with reference made to FIG. 1. However, it should be appreciated that the manufacturing process mentioned below is merely an exemplary example for forming the acoustics transducer of an embodiment of the disclosure. One skilled in the art may exchange, add, or modify the mentioned manufacturing process to accomplish an acoustics transducer according to an embodiment of the present disclosure. Thus, the illustration below is merely a example of a method for forming an embodiment of the disclosure. The manufacturing process of an embodiment of the disclosure is not limited thereto.

As shown in FIG. 1, in one embodiment, a support substrate 100 is first provided. Then, a patterned conducting layer is formed overlying an upper surface 100*a* of the support substrate 100. The patterned conducting layer will become a vibratable membrane 104 in the following process. The patterned conducting layer (or vibratable membrane) may include a conducting material, such as a metal material, a semiconductor material, a conducting ceramic material, a conducting polymer material, or combinations thereof. An insulating layer is then formed overlying the support substrate 100 and the patterned conducting layer. The insulating layer will become an insulating spacer 110 in the following process. Then, a metal layer is formed overlying the insulating layer to serve as a back plate 106, and a plurality of holes 108 may be formed therein. Then, a portion of the support substrate 100 is removed from the lower surface 100*b* of the support substrate 100 to form a recess 102*a* by an anisotropic etching process. After the recess 102*a* is formed, the previously formed patterned conducting layer now becomes a vibratable membrane 104. The vibratable membrane 104 includes a fixed portion and a suspended portion. The fixed portion is fixed overlying the support substrate 100 (not shown in FIG. 1). The suspended portion is separated from the support substrate 100 by a gap as shown in FIG. 1. An opening of the recess 102*a* has a shape substantially the same as the shape of the suspended portion of the vibratable membrane 104 and has an area slightly larger than that of the suspended portion, such that the suspended portion of the vibratable membrane 104 and the support substrate are separated from each other by a gap. Then, a portion of the insulating layer between the back plate 106 and the vibratable membrane 104 is removed while only an insulating spacer 110 is left between the back plate 106 and the vibratable membrane 104. Thus, an acoustics transducer 10 according to an embodiment of the disclosure is accomplished. It should be noted that an embodiment of the disclosure is not limited to be formed by the method mentioned above. For example, an insulating spacer 110 and a back plate 106 may be formed first, followed by forming a recess 102*a*.

Figure 2A:
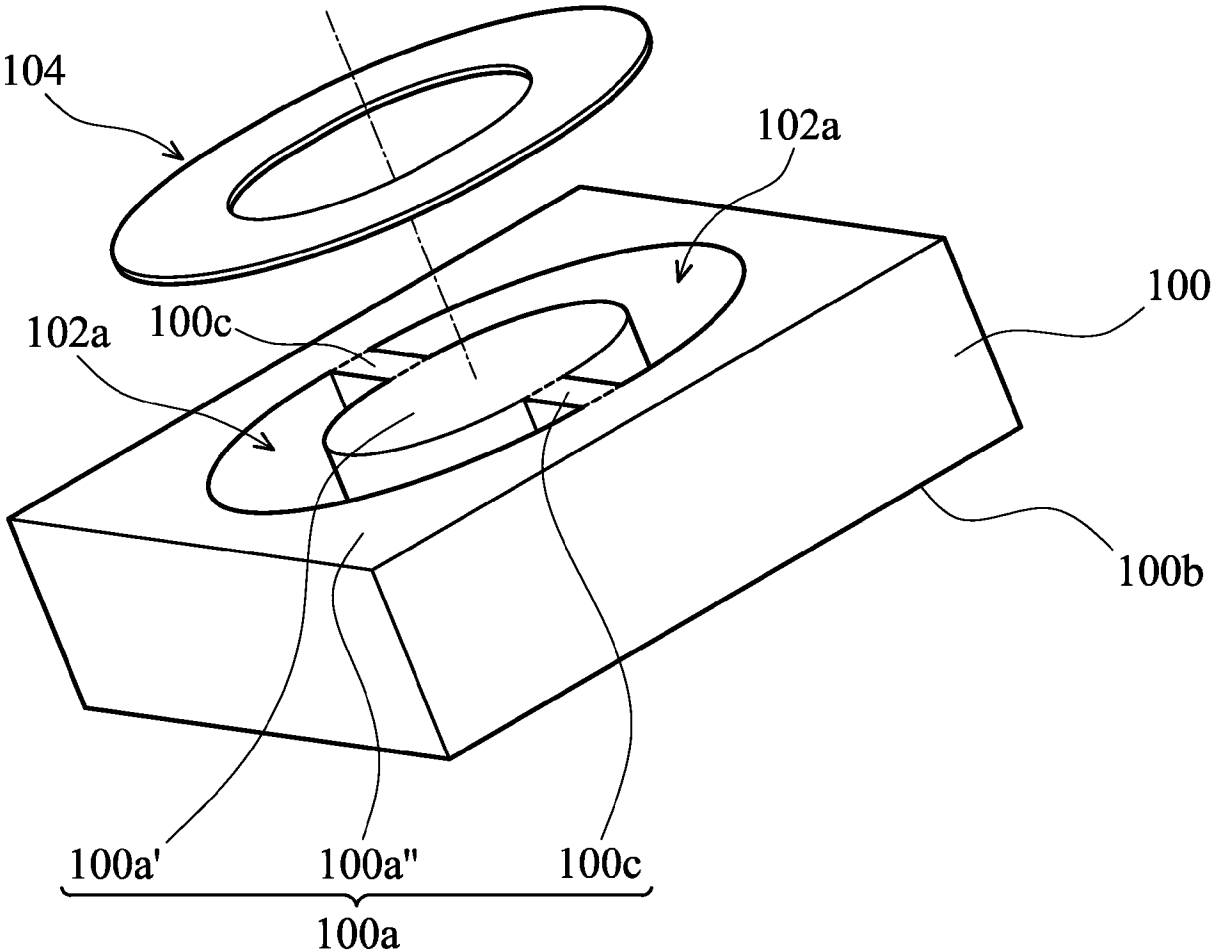
FIG. 2A is a three-dimensional, exploded view showing an acoustics transducer having a support substrate with a recess and a vibratable membrane according to an embodiment of the present disclosure.
Figure 2B:
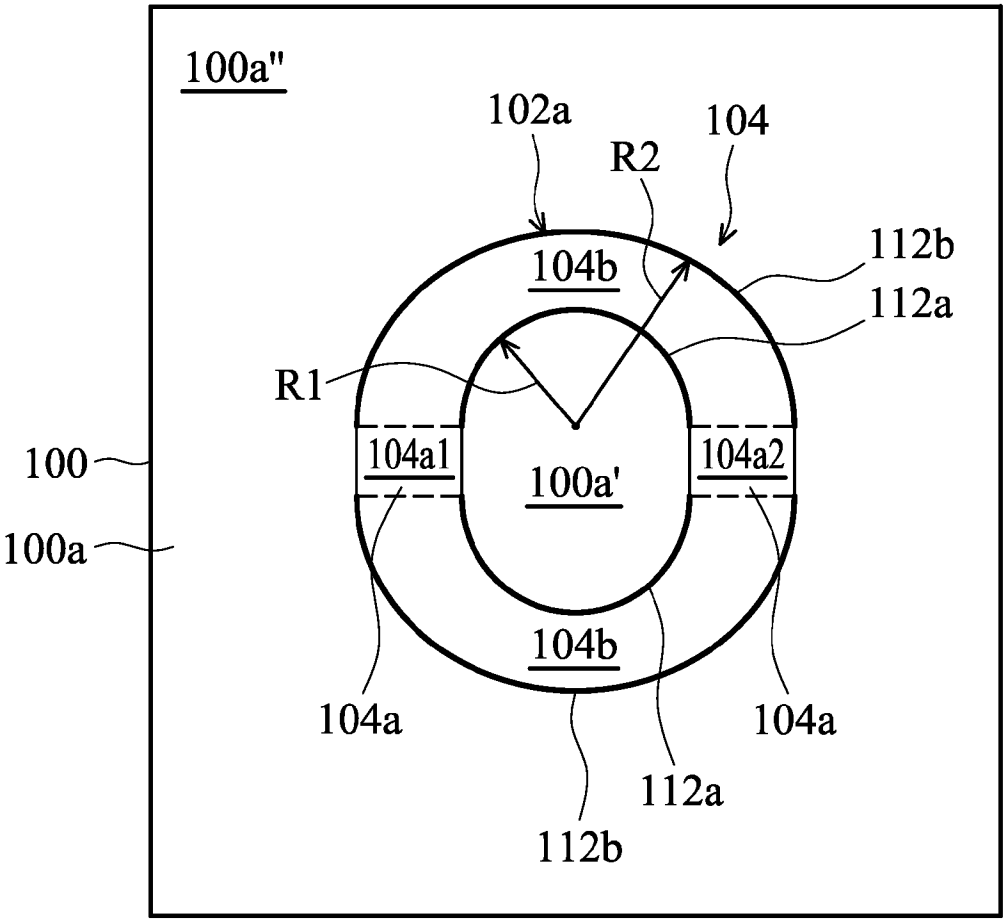
FIG. 2B is a top view showing an acoustics transducer having a vibratable membrane disposed on a support substrate with a recess according to an embodiment of the present disclosure.

In embodiments of the disclosure, due to a special disposition of the support substrate 100, the recess 102*a*, and the vibratable membrane 104, sensitivity of the acoustics transducer 10 is improved and residual stress in the membrane is significantly reduced or released. Thereafter, the special disposition of the support substrate 100, the recess 102*a*, and the vibratable membrane 104 of an acoustics transducer 10 according to an embodiment of the present disclosure is illustrated with reference made to FIGS. 2A-2B. FIG. 2A is a three-dimensional exploded view showing an embodiment having a support substrate with a recess 102*a* and a vibratable membrane 104. FIG. 2B is a top view showing an embodiment having a vibratable membrane 104 disposed on a support substrate 100 with a recess 102*a*.

As shown in FIGS. 2A and 2B, in one embodiment, an upper surface 100*a* of a support substrate 100 includes a first portion 100*a*' and a second portion 100*a*", wherein the second portion 100*a*" surrounds the first portion 100*a*'. A recess 102*a* is between the first portion 100*a*' and the second portion 100*a*". The recess 102*a* extends from the upper surface 100*a* towards the lower surface 100*b* of the support substrate 100. In one embodiment, the recess 102*a* completely penetrates through the support substrate 100.

As shown in FIGS. 2A and 2B, in one embodiment, the vibratable membrane 104 is disposed overlying the support substrate 100 and directly on the recess 102*a*. As shown in FIG. 2B, the vibratable membrane 104 includes a fixed portion 104*a* and a suspended portion 104*b*. The vibratable membrane 104 is fixed overlying the support substrate 100 through the fixed portion 104*a*. For example, in the embodiment shown in FIGS. 2A and 2B, the fixed portion 104*a* of the vibratable membrane 104 connects with a linking portion 100*c* connecting the first portion 100*a*' and the second portion 100*a*" of the support substrate 100. Thus, the vibratable membrane 104 is fixed on the support substrate 100. In this case, the fixed portion 104*a* includes a first fixed region 104*a*1 and a second fixed region 104*a*2. The first fixed region 104*a*1 is fixed on the left-side linking portion 100*c* while the second fixed region 104*a*2 is fixed on the right-side linking portion 100*c*. In the embodiment shown in FIG. 2B, the first fixed region 104*a*1 and the second fixed region 104*a*2 connect with two ends of the suspended portion 104*b* of the vibratable membrane 104, respectively. In the embodiment shown in FIG. 2B, the vibratable membrane 104 surrounds the first portion 100*a*' of the upper surface 100*a*.

As mentioned above, the recess 102*a* may be formed after a shape of the vibratable membrane 104 is defined. An opening of the recess 102*a* near the upper surface 100*a* may have a shape substantially the same as that of the suspended portion

104*b* of the vibratable membrane 104 and have an area slightly larger than that of the suspended portion 104*b*. That is, an edge of the suspended portion 104*b* of the vibratable membrane 104 extends substantially along with an edge of the opening of the recess 102*a*. An outline of the edge of the suspended portion 104*b* is substantially the same as an outline of the opening of the recess 102*a* near the upper surface 100*a*. However, it should be appreciated that embodiments of the disclosure are not limited to the specific example mentioned above. In another embodiment, an edge of the suspended portion 104*b* of the vibratable membrane 104 need not necessarily extend completely along with an edge of the opening of the recess 102*a*. That is, the suspended portion 104*b* of the vibratable membrane 104 may have a shape not completely similar to the shape of the opening of the recess 102*a* near the upper surface 100*a*.

As shown in FIG. 2B, in this embodiment, an inner gap 112*a* is between the suspended portion 104*b* of the vibratable membrane 104 and the first portion 100*a*' of the upper surface 100*a* of the support substrate 100. An outer gap 112*b* is between the suspended portion 104*b* and the second portion 100*a*" and the upper surface 100*a*. Wherein, the inner gap 112*a* and the outer gap 112*b* may also be named as free boundaries. In one embodiment, the inner gap 112*a* and the outer gap 112*b* occupy an area of about 0.1% to 2% of an area of the vibratable membrane 104. In another embodiment, the inner gap 112*a* and the outer gap 112*b* occupy an area of about 0.5% to 1.5% of the vibratable membrane 104. However, it should be appreciated that the area percentage occupied by the inner gap 112*a* and the outer gap 112*b* mentioned above is merely a specific example of the disclosure. Embodiments of the disclosure are not limited thereto.

In one embodiment of the disclosure, because the vibratable membrane 104 is separated from the support substrate 100 by the inner gap 112*a* and the outer gap 112*b* therebetween, the vibratable membrane 104 is not too hard to be deformed and not too soft to have insufficient sensitivity. In addition, according to the inventor's research, it was discovered that because both an inner side and an outer side of the vibratable membrane 104 have a free boundary (i.e., the inner gap 112*a* and the outer gap 112*b*), stress may be released at the gaps near the inner side and the outer side of the vibratable membrane. Structural deformations or damages caused by a residual stress, such as a compressive stress and/or tensile stress, may be prevented. Thus, stress residing in the vibratable membrane 104 may be reduced or released significantly which facilitates sensitivity and reliability of the acoustics transducer.

In addition, according to the inventor's research, it is preferable that the inner gap 112*a* and the outer gap 112*b* may include at least an arc portion. A gap including an arc portion may provide the benefit of reducing or releasing residual gradient stress. In one embodiment, the outer gap 112*b* includes at least an arc portion. In another embodiment, the inner gap 112*a* includes at least an arc portion. In yet another embodiment, both the inner gap 112*a* and the outer gap 112*b* include at least an arc portion.

For example, in the embodiment shown in FIG. 2B, the entire inner gap 112*a* and the entire outer gap 112*b* are both arc portions. In this embodiment, the first portion 100*a*' of the upper surface 100*a* includes two semi-circular portions and a rectangle portion between the two semi-circular portions. Alternatively, in another embodiment, the first portion 100*a*' of the upper surface 100*a* may include a fan-shaped portion. The fan-shaped portion may include, for example, a three fourth circle portion or a five eighth circle portion. That is, the portions between the rectangular portions are not limited to be a "semi-circular" portion.

In one embodiment, the inner gap 112*a* and the outer gap 112*b* may comprise two circular-arc portions having the same center of curvature, wherein the circular-arc portion of the outer gap 112*b* has a radius of curvature R2 larger than a radius of curvature R1 of the circular-arc portion of the inner gap 112*a*. In one embodiment, if the radius of curvature R2 of the outer gap 112*b* is twice that of the radius of curvature R1 of the inner gap 112*a*, deformation or damage to the vibratable membrane 104 caused by residual stress may be reduced to a minimum degree. However, it should be noted that the ratio between radiuses of curvature mentioned above is merely a preferable value of a specific embodiment. In another embodiment, a preferable ratio between the radiuses of curvature may be a different value, depending on the condition of residual stress.

An acoustics transducer according to an embodiment of the disclosure may have a variety of variations. Thereafter, some variations will be illustrated with reference made to the accompany drawings, wherein similar or same reference numbers are used to designate similar or same elements. However, it should be appreciated that this repetition is for the purpose of simplicity and clarity and does not in itself dictate a relationship between the various embodiments and/or configurations discussed.

Figure 3A:
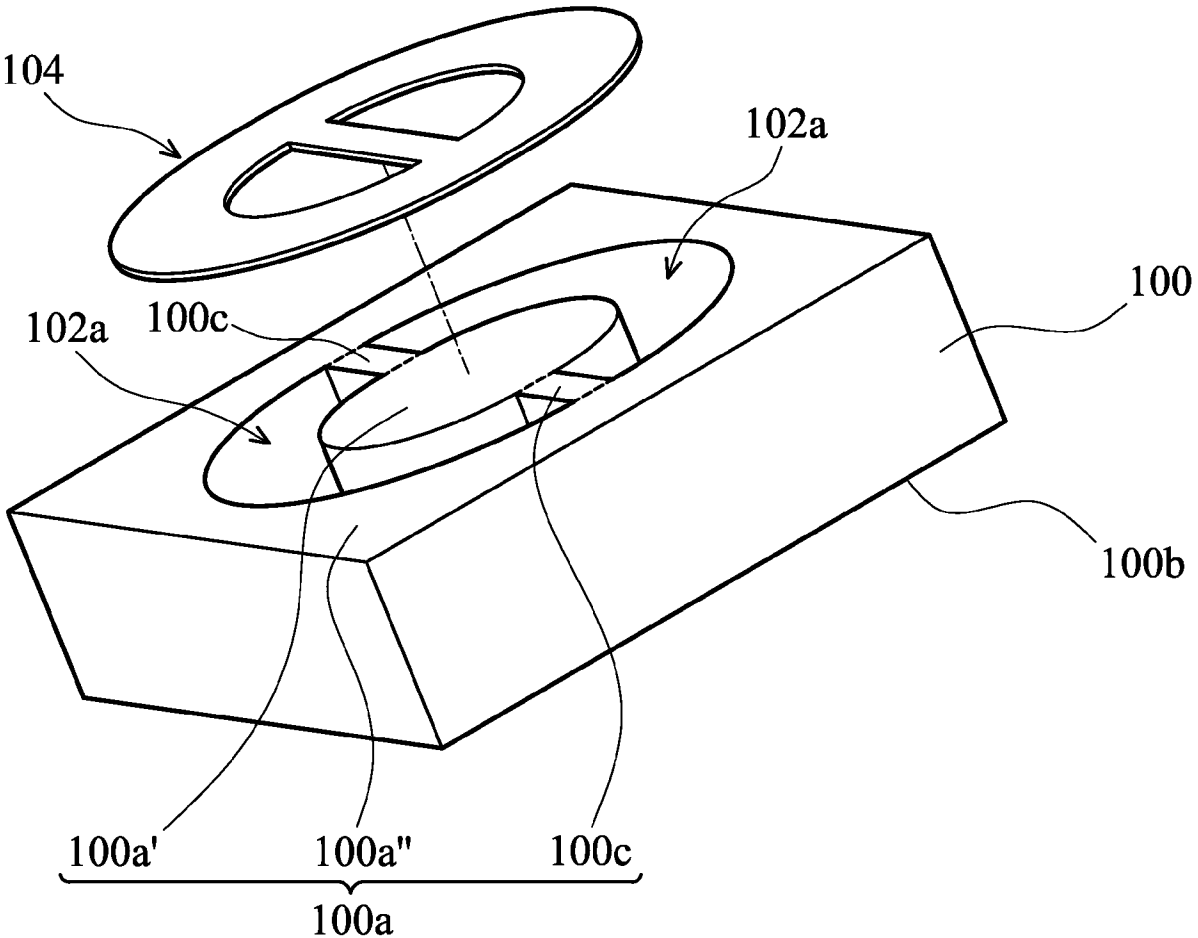
FIG. 3A is a three-dimensional exploded view showing an acoustics transducer having a support substrate with a recess and a vibratable membrane according to another embodiment of the present disclosure.
Figure 3B:
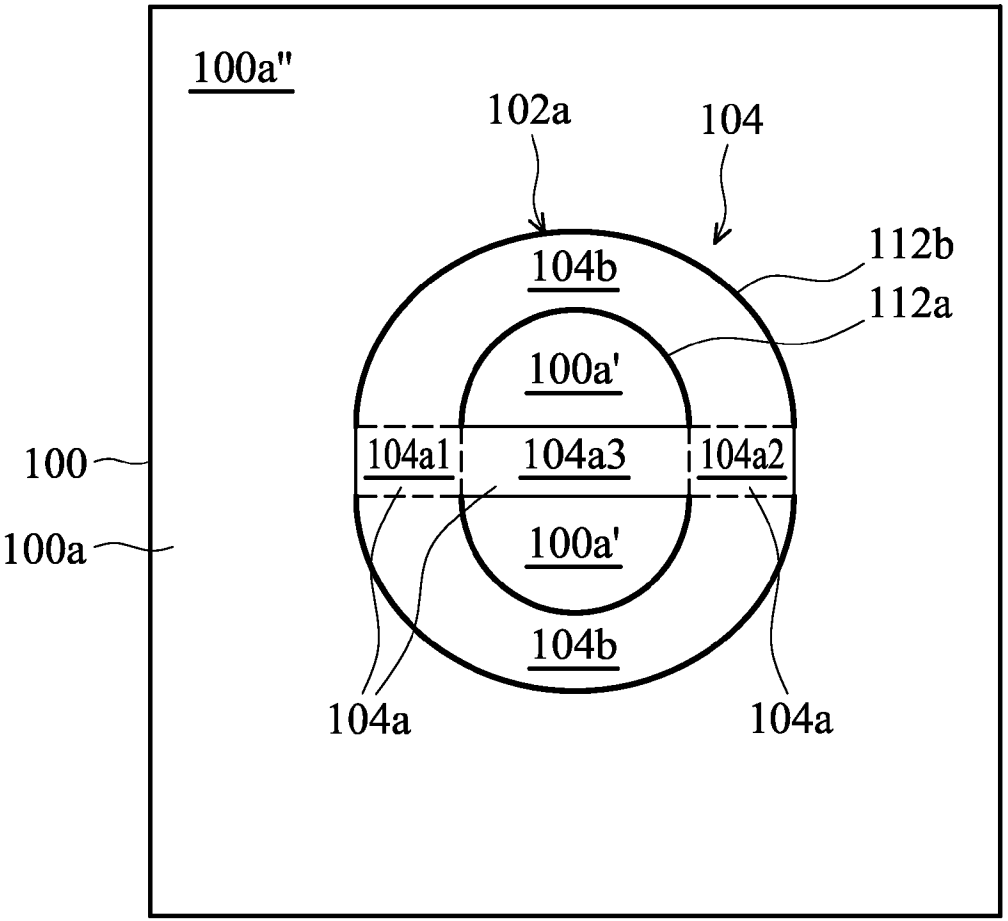
FIG. 3B is a top view showing an acoustics transducer having a vibratable membrane disposed on a support substrate with a recess according to another embodiment of the present disclosure.

FIG. 3A is a three-dimensional exploded view showing an embodiment having a support substrate with a recess 102*a* and a vibratable membrane 104. FIG. 3B is a top view showing an embodiment having a vibratable membrane 104 disposed on a support substrate 100 with a recess 102*a*.

The embodiment shown in FIGS. 3A and 3B is similar to that shown in FIGS. 2A and 2B. The main difference therebetween is that the fixed portion 104*a* of the vibratable membrane 104 in the embodiment shown in FIGS. 3A and 3B further includes a third fixed region 104*a*3 connected with the first fixed region 104*a*1 and the second fixed region 104*a*2. The third fixed region 104*a*3 may be fixed overlying the support substrate 100. As shown in FIG. 3B, in this embodiment, the third fixed region 104*a*3 further traverses the first portion 100*a*' of the upper surface 100*a* of the support substrate 100 and connects with a portion of the first portion 100*a*'. The third fixed region 104*a*3 of the vibratable membrane 104 functions to improve the bonding strength between the vibratable membrane 104 and the support substrate 100. The third fixed region 104*a*3 further facilitates to even up the entire vibratable membrane 104, which improves performance of the acoustics transducer 10.

Figure 4:
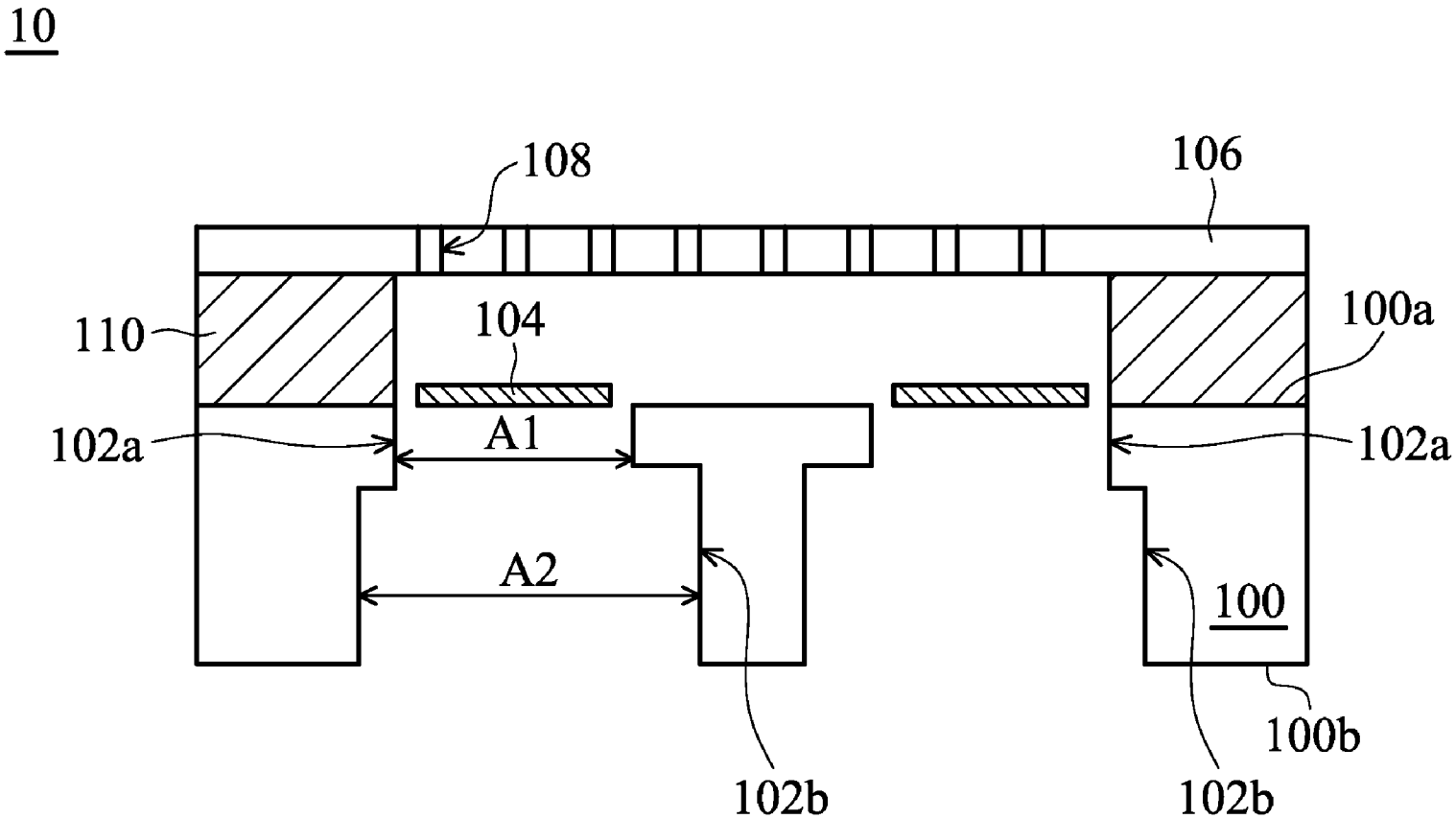
FIG. 4 is a cross-sectional view showing an acoustics transducer according to an embodiment of the present disclosure.

In addition, in another embodiment such as that shown in FIG. 4, the acoustics transducer 10 may further include a second recess 102*b* located under the recess 102*a*, wherein the second recess 102*b* and the recess 102*a* are connected with each other. The additionally formed second recess 102*b* which connects with the recess 102*a* increases space below the vibratable membrane 104. When the vibratable membrane 104 is affected by a sound wave and moves downward or deforms, air resistance encountered by the vibratable membrane 104 can be reduced with larger space thereunder. The vibratable membrane 104 may thus deform to a higher degree, and thus the sensitivity of the acoustics transducer is improved. As mentioned above, the opening of the recess 102*a* needs to have a shape similar to that of the vibratable membrane 104 and must be slightly larger such that the vibratable membrane 104 is separated from the support substrate 100 only by the inner gap 112*a* and the outer gap 112*b*. In one embodiment, after the recess 102*a* is formed, another etching process may be performed to form the second recess 102*b* which connects with the recess 102*a*. For example, the second recess 102*b* may be located below the recess 102*a*, as shown in FIG. 4. The second recess 102*b* may have a cross-sectional area A2 larger than a cross-sectional area A1 of the recess 102*a*. One reason for forming the second recess 102*b* is to increase space under the vibratable membrane 104. Thus, the shape of the opening of the second recess 102*b* may be different from that of the opening of the recess 102*a*. Both the recesses 102*a* and 102*b*, which are linking together, are used as back chambers of the acoustics transducer 10.

Figure 5:
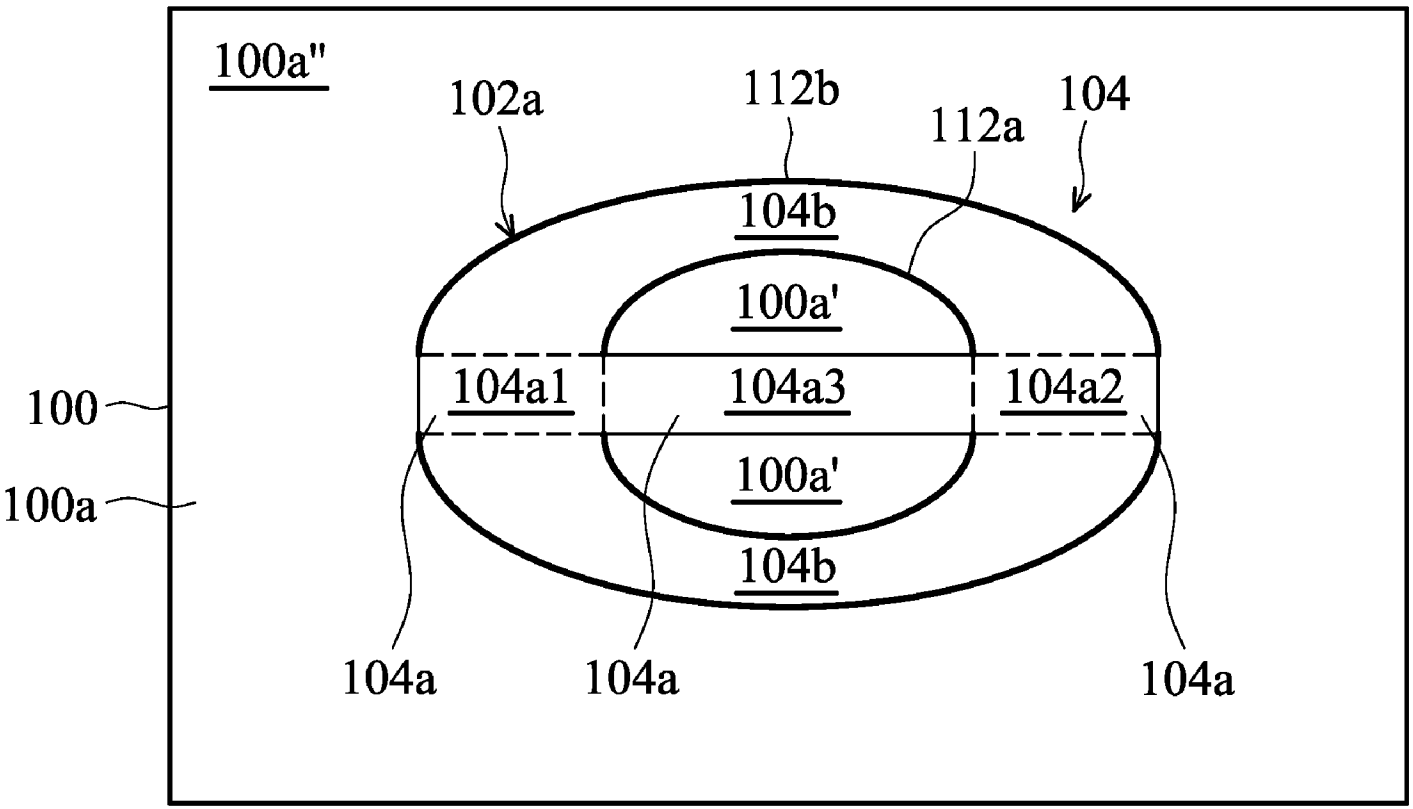
FIG. 5 is a top view showing an acoustics transducer having a vibratable membrane disposed on a support substrate with a recess according to yet another embodiment of the present disclosure.

In addition, embodiments of the disclosure may further have many variations. For example, the first portion 100*a*' of the upper surface 100*a* not only includes the semi-circular portion, the fan-shaped portion, and/or the rectangle portion mentioned in FIGS. 1 and 2, but also may include, for example, a semi-ellipse portion. FIG. 5 is a top view showing an acoustics transducer having a vibratable membrane disposed on a support substrate with a recess according to yet another embodiment of the present disclosure, wherein same or similar reference numbers are used to designate same or similar elements. As shown in FIG. 5, in this embodiment, edges of the inner gap 112*a* and the outer gap 112*b* between the vibratable membrane 104 and the support substrate 100 extend along with an edge of the semi-ellipse portion. The inner gap 112*a* and the outer gap 112*b* respectively have an arc portion (elliptic-arc), facilitating the reduction or releasing of residual stress in the vibratable membrane 104.

Figure 6:
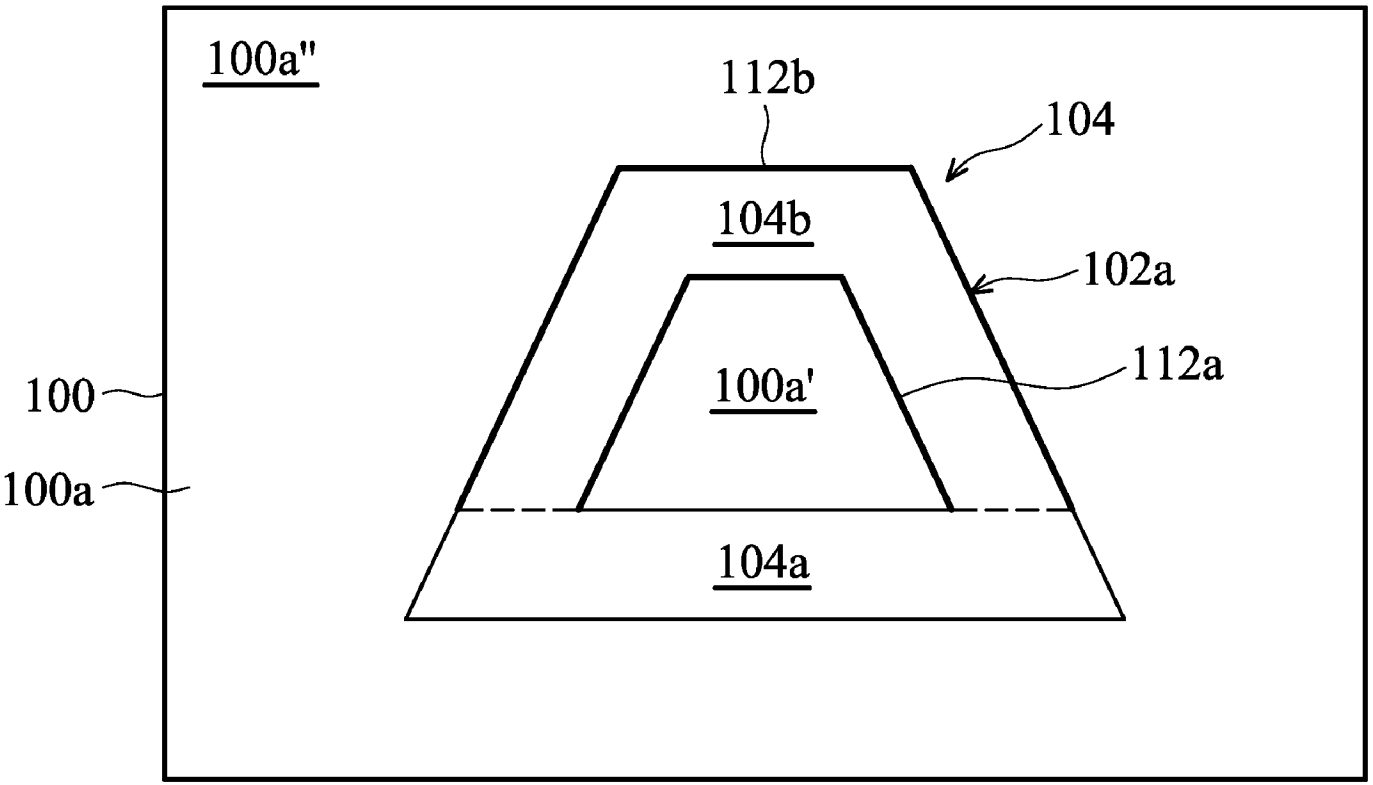
FIG. 6 is a top view showing an acoustics transducer having a vibratable membrane disposed on a support substrate with a recess according to yet another embodiment of the present disclosure.

Although both the inner gap 112*a* and the outer gap 112*b* between the vibratable membrane 104 and the support substrate 100 include an arc portion in the embodiment mentioned above, embodiments of the present disclosure are not limited thereto. In another embodiment, the inner gap 112*a* and the outer gap 112*b* may include no arc portion. For example, in one embodiment, the first portion 100*a*' of the upper surface 100*a* may include a polygon portion, such as that shown in FIG. 6. In the embodiment shown in FIG. 6, the first portion 100*a*' includes a trapezoid portion. The inner gap 112*a* and the outer gap 112*b* between the vibratable membrane 104 and the support substrate 100 extend along with an outline of the trapezoid portion, such that the inner gap 112*a* and the outer gap 112*b* have no arc portion. Even though, the inner gap 112*a* and the outer gap 112*b* between the vibratable membrane 104 and the support substrate 100 are still capable of releasing a stress near an inner side and an outer side of the vibratable membrane 104, significantly improving sensitivity and reliability of the acoustics transducer 10. In addition, the polygon portion not only includes, for example, a trapezoid portion, but also includes a diamond portion, hexagon portion, octagon portion, or dodecagon portion. In other words, the first portion 100*a*' of an embodiment of the disclosure may include any kind of shape. Since the support substrate and the vibratable membrane 104, which is fixed directly on the recess 102*a* between the first portion 100*a*' and the second portion 100*a*", are separated from each other by the inner gap 112*a* and the outer gap 112*b*, sensitivity and reliability of the acoustics transducer 10 may be improved.

It should be noted that although the vibratable membrane of the acoustics transducer in the embodiments mentioned above surrounds a portion of the support substrate, such as the first portion of the upper surface, embodiments of the present disclosure are not limited thereto. In another embodiment, a vibratable membrane of an acoustics transducer does not surround a portion of a support substrate. In addition, an acoustics transducer of an embodiment of the disclosure may include a combination of a plurality of vibratable membranes.

Figure 7A:
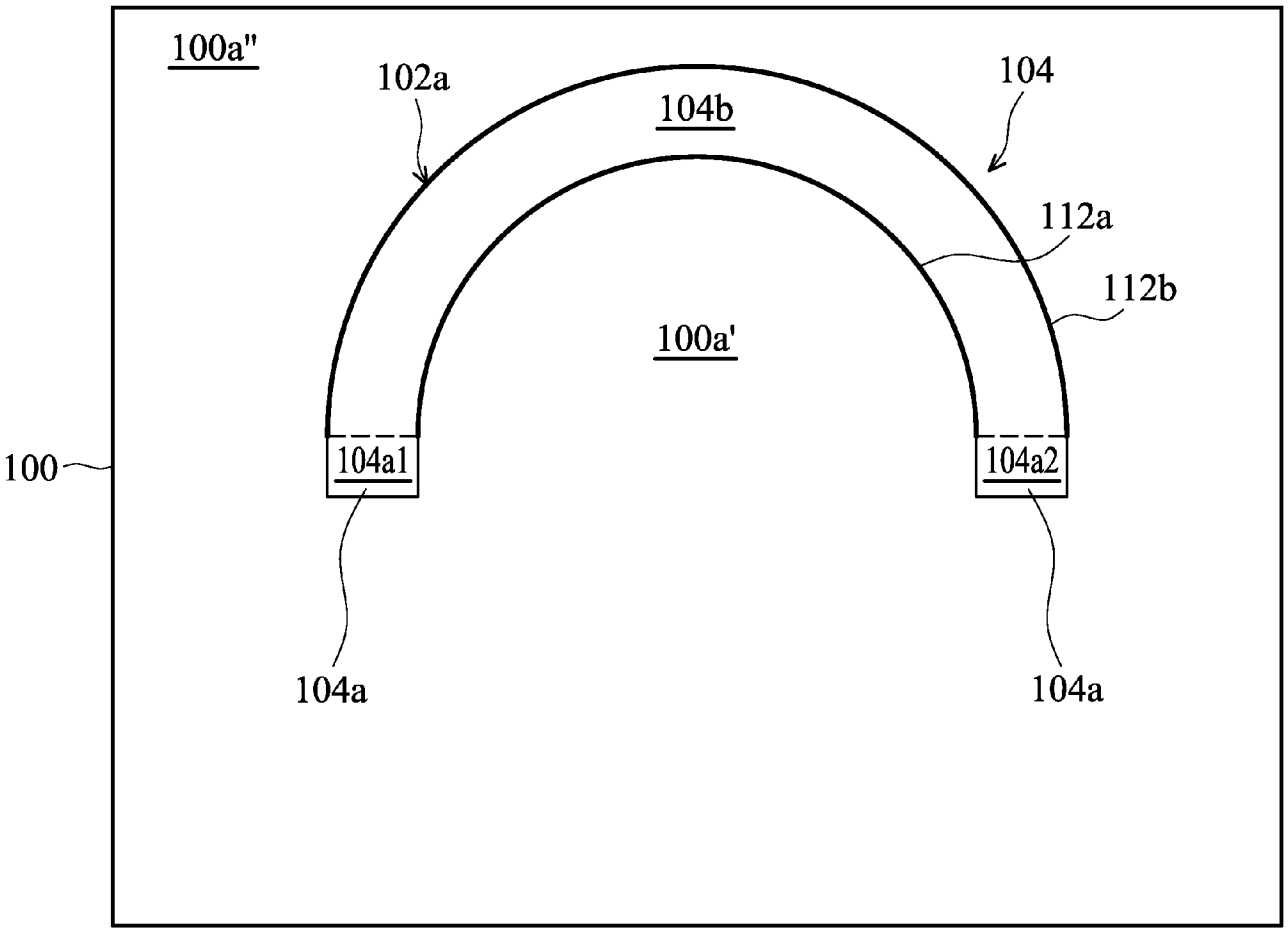
FIGS. 7A-7C are top views showing acoustics transducers having a vibratable membrane disposed on a support substrate with a recess according to embodiments of the present disclosure.
Figure 7B:
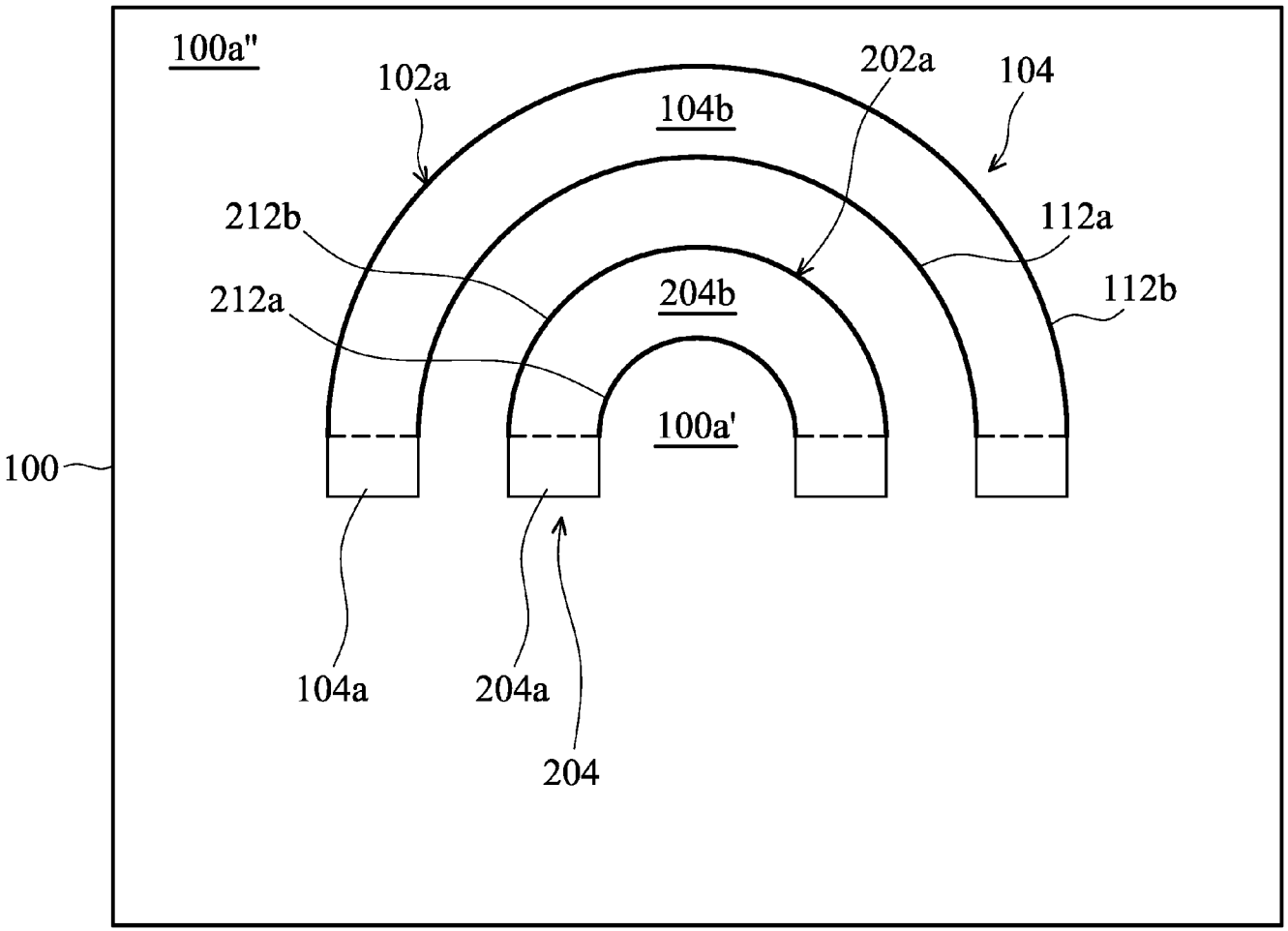
Figure 7C:
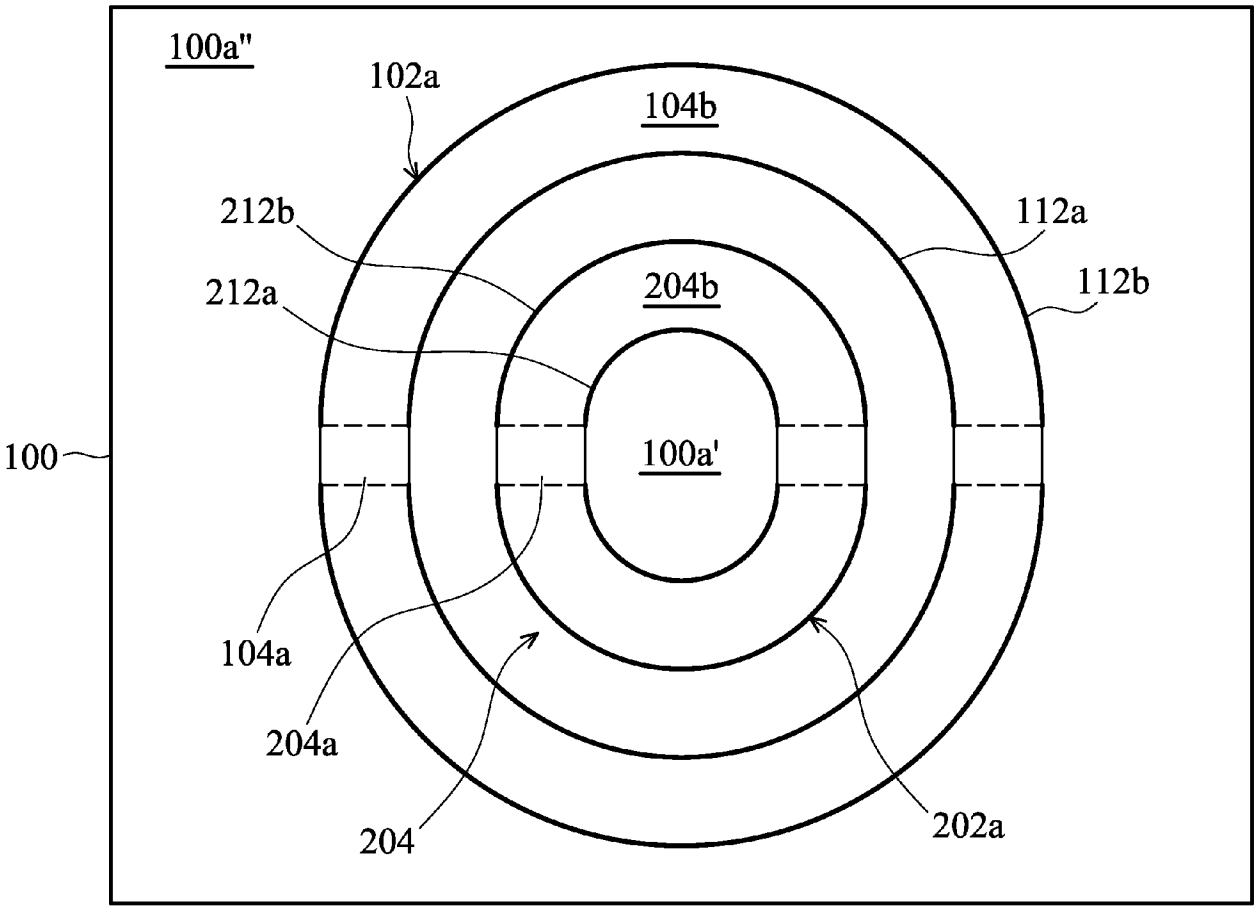

FIGS. 7A-7C are top views showing acoustics transducers having a vibratable membrane disposed on a support substrate with a recess according to embodiments of the present disclosure, wherein similar or same reference numbers are used to designate similar or same elements.

As shown in FIG. 7A, the acoustics transducer of this embodiment includes a support substrate 100 having an upper surface and a lower surface (referring to FIG. 1 or 4 which respectively show the upper surface 100*a* and the lower surface 100*b*). The upper surface 100 includes a first portion 100*a*' and a second portion 100*a*". The outer second portion 100*a*" surrounds the inner first portion 100*a*'. The acoustics transducer further includes a recess 102*a* extending from the upper surface towards the lower surface (referring to FIG. 1 or 4). The recess 102*a* is between the first portion 100*a*' and the second portion 100*a*" of the upper surface. The acoustics transducer further includes a vibratable membrane 104 disposed directly on the recess 102*a*. The vibratable membrane 104 includes a fixed region 104*a* and a suspended portion 104*b*. The fixed portion 104*a* is fixed overlying the support substrate 100. An edge of the suspended portion 104*b* extends substantially along with an edge of an opening of the recess 102*a*. An inner gap 112*a* is between the suspended portion 104*b* and the first portion 100*a*' of the upper surface while an outer gap 112*b* is between the suspended portion 104*b* and the second portion 100*a*" of the upper surface. The acoustics transducer may further includes a back plate (referring to FIG. 1 or 4) disposed overlying the support substrate 100 and separated from the vibratable membrane 104 by a space. In the embodiment shown in FIG. 7A, the inner and outer gaps 112*a* and 112*b* between the vibratable membrane 104 and the support substrate 100 facilitate reducing or releasing of a residual stress, such as a compressive stress or a tensile stress in the vibratable membrane 104. In the embodiment shown in FIG. 7A, the inner and outer gaps 112*a* and 112*b* are portions of two circles with a same center. Thus, both the inner and outer gaps 112*a* and 112*b* include an arc portion, which facilitates reducing or releasing of gradient stress.

In addition, an acoustics transducer of an embodiment of the disclosure may include a combination of a plurality of vibratable membranes. For example, in the embodiments shown in FIGS. 7B and 7C, the acoustics transducer includes at least a second vibratable membrane 204 and a respective second recess 202*a*. The vibratable membrane 204 is disposed overlying the support substrate 100 and located directly on the second recess 202*a*. The vibratable membrane 204 includes a fixed portion 204*a* and a suspended portion 204*b* and is separated from the support substrate by an inner gap 212*a* and an outer gap 212*b*. However, it should be appreciated that the embodiments shown in FIGS. 7B and 7C are merely specific examples. Embodiments of the present disclosure are not limited thereto. For example, in another embodiment, another combination type, such as combinations of the embodiments shown in FIGS. 2B and 6, or arrangements of a variety of vibratable membranes disposed overlying the support substrate may be adopted. In addition, a plurality of arrays of vibratable membranes, such as an array of a combination of the embodiment shown in FIG. 7C, may be disposed overlying the support substrate, depending on requirement. Further, in one embodiment, recesses below the vibratable membranes may be connected with each other. For example, in the embodiments shown in FIGS. 7B and 7C, the recesses 102*a* and 202*a* may connect with each other. In another embodiment, the vibratable membranes are separated from each other by a thin slit. For example, in the embodiment shown in FIG. 7B, the vibratable membranes 104*n* and 204*b* are separated from each other by a thin slit. The slit may have a width substantially equal to a distance between the vibratable membrane 104*b* and the recess 102*a*.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An acoustics transducer, comprising:

a support substrate having an upper surface and a lower surface, the upper surface comprising a first portion and a second portion surrounding the first portion, and a linking portion connecting the first portion and the second portion of the upper surface of the support substrate;

a first recess extending from the upper surface towards the lower surface, wherein the first recess is between the first portion and the second portion;

a vibratable membrane disposed directly on the first recess, the vibratable membrane comprising a fixed portion and a suspended portion, wherein:

the fixed portion is fixed on the support substrate, an edge of the suspended portion extends substantially along with an edge of an opening of the first recess, an inner gap is between the suspended portion and the first portion of the upper surface, and an outer gap is between the suspended portion and the second portion of the upper surface; and a back plate disposed overlying the support substrate and opposite to the vibratable membrane.

2. The acoustics transducer as claimed in claim 1, wherein the vibratable membrane surrounds the first portion of the upper surface.

3. The acoustics transducer as claimed in claim 1, wherein a shape of the suspended portion of the vibratable membrane and a shape of the opening of the first recess are the same, and the suspended portion has an area smaller than that of the opening of the first recess.

4. The acoustics transducer as claimed in claim 1, wherein the inner gap comprises at least an arc portion.

5. The acoustics transducer as claimed in claim 1, wherein the outer gap comprises at least an arc portion.

6. The acoustics transducer as claimed in claim 1, wherein the fixed portion of the vibratable membrane comprises a first fixed region and a second fixed region fixed on the support substrate, respectively.

7. The acoustics transducer as claimed in claim 6, wherein the first fixed region and the second fixed region connect two ends of the suspended portion, respectively.

8. The acoustics transducer as claimed in claim 7, wherein the vibratable membrane further comprises a third fixed region connected with the first fixed region and the second fixed region and fixed on the support substrate.

9. The acoustics transducer as claimed in claim 8, wherein the third fixed region traverses the first portion of the upper surface of the support substrate.

10. The acoustics transducer as claimed in claim 1, wherein the first portion of the upper surface comprises a semi-circular portion or a fan-shaped portion.

11. The acoustics transducer as claimed in claim 10, wherein the inner gap and the outer gap comprise two circular-arc portions having a same center of curvature, and the circular-arc portion of the outer gap has a radius of curvature larger than that of the circular-arc portion of the inner gap.

12. The acoustics transducer as claimed in claim 11, wherein the radius of curvature of the circular arc portion of the outer gap is about two times of the radius of curvature of the circular arc portion of the inner gap.

13. The acoustics transducer as claimed in claim 1, wherein the first portion of the upper surface comprises a semi-ellipse portion.

14. The acoustics transducer as claimed in claim 1, wherein the first portion of the upper surface comprises a polygon portion.

15. The acoustics transducer as claimed in claim 1, further comprising a second recess located under the first recess, wherein the second recess and the first recess connect with each other.

16. The acoustics transducer as claimed in claim 15, wherein the second recess has a cross-sectional area larger than that of the first recess.

17. The acoustics transducer as claimed in claim 1, further comprising at least a hole penetrating through the back plate.

18. The acoustics transducer as claimed in claim 1, wherein the vibratable membrane comprises a conducting material.

19. The acoustics transducer as claimed in claim 18, wherein the conducting material comprises a metal material, a semiconductor material, a conducting ceramic material, a conducting polymer material, or combinations thereof.

20. The acoustics transducer as claimed in claim 1, further comprising an insulating spacer disposed between the vibratable membrane and the back plate.

21. The acoustics transducer as claimed in claim 1, wherein the fixed portion is fixed on the linking portion of the support substrate.

* * * * *